US011105321B2

(12) United States Patent
Mizukoshi

(10) Patent No.: US 11,105,321 B2
(45) **Date of Patent: *Aug. 31, 2021**

(54) PLUNGER PUMP HAVING A ROTATABLE PLUNGER WITH CUT FACE DISPOSED IN A CYLINDER WHEREIN THE CYLINDER INCLUDES A MAIN BODY AND A SPACER SECTION WITH THE SPACER SECTION HAVING A GREATER LENGTH IN AN AXIAL DIRECTION THAN THE MAXIMUM STROKE LENGTH OF THE PLUNGER

(71) Applicant: IWAKI CO., LTD., Tokyo (JP)

(72) Inventor: Mikio Mizukoshi, Sayama (JP)

(73) Assignee: IWAKI CO., LTD., Tokyo (JP)

( * ) Notice: Subject to any disclaimer, the term of this patent is extended or adjusted under 35 U.S.C. 154(b) by 123 days.

This patent is subject to a terminal disclaimer.

(21) Appl. No.: 15/869,262

(22) Filed: Jan. 12, 2018

(65) Prior Publication Data

US 2019/0101107 A1 Apr. 4, 2019

(30) Foreign Application Priority Data

Sep. 29, 2017 (JP) ..... JP2017-191361

(51) Int. Cl.
*F04B 7/00* (2006.01)
*F04B 53/14* (2006.01)
(Continued)

(52) U.S. Cl.
CPC ..... *F04B 7/0046* (2013.01); *F04B 7/0053* (2013.01); *F04B 7/0088* (2013.01);
(Continued)

(58) Field of Classification Search
CPC ..... F04B 53/143; F04B 7/0046; F04B 17/03; F04B 53/02; F04B 53/14; F04B 53/162;
(Continued)

(56) References Cited

U.S. PATENT DOCUMENTS 1,819,759 A * 8/1931 Valletta ..... F02F 1/18 123/193.2
2,513,883 A * 7/1950 Male ..... F02M 59/26 417/493
(Continued)

FOREIGN PATENT DOCUMENTS

CN 107023450 A 8/2017
JP S59-19981 U 2/1984
(Continued)

OTHER PUBLICATIONS

Mar. 23, 2021 Office Action issued in Japanese Patent Application No. 2017-191361.

*Primary Examiner* — Patrick Hamo
*Assistant Examiner* — Benjamin Doyle
(74) *Attorney, Agent, or Firm* — Oliff PLC

(57) ABSTRACT

Plunger pump includes cylinder having inside cylinder chamber; plunger disposed in cylinder to be relatively movable forward and backward to cylinder chamber so outer plunger's circumferential face is in slide contact with cylinder's inner circumferential face, and having cut face on distal end's outer periphery; and suction and discharge ports provided to cylinder to communicate with cylinder chamber, plunger pump transferring fluid by reciprocating plunger in axial direction while rotating plunger relative to cylinder chamber to let suction and discharges ports alternately communicate with cylinder chamber, wherein cylinder includes cylinder main body and spacer section being disposed in cylinder main body's inner portion of proximal end side, and sliding against plunger's portion closer to proximal end side than portion of plunger advancing and retracting into cylinder chamber, and plunger pump further includes seal section provided on cylinder's proximal end side for sealing cylinder main body, plunger and spacer section.

9 Claims, 3 Drawing Sheets

(51) Int. Cl.

| | |
|---|---|
| ***F04B 53/02*** | (2006.01) |
| ***F04B 53/16*** | (2006.01) |
| ***F04B 7/06*** | (2006.01) |
| ***F04B 17/03*** | (2006.01) |
| ***F04B 9/04*** | (2006.01) |

(52) U.S. Cl.
CPC ..... *F04B 7/06* (2013.01); *F04B 53/02* (2013.01); *F04B 53/14* (2013.01); *F04B 53/143* (2013.01); *F04B 53/162* (2013.01); *F04B 53/164* (2013.01); *F04B 9/047* (2013.01); *F04B 17/03* (2013.01)

(58) Field of Classification Search
CPC .... F04B 53/164; F04B 7/0053; F04B 7/0088; F04B 7/06; F04B 9/047
USPC ..... 417/490–501; 92/155
See application file for complete search history.

(56) References Cited

U.S. PATENT DOCUMENTS 3,033,183 A * 5/1962 Erickson ..... F02F 1/08 123/41.69
3,120,811 A * 2/1964 Jemison ..... A47L 15/4418 417/415
3,382,812 A * 5/1968 Smith ..... F04B 7/06 417/500
3,834,715 A * 9/1974 Butler ..... F04B 53/164 277/308
4,008,003 A * 2/1977 Pinkerton ..... F04B 5/02 417/250
4,386,782 A * 6/1983 Reverberi ..... F04B 53/164 277/563
4,392,508 A * 7/1983 Switall ..... A01M 7/0092 137/99
4,531,840 A * 7/1985 Clark ..... B01F 15/0429 366/142
4,531,897 A * 7/1985 Orlita ..... F04B 7/06 417/500
4,575,317 A * 3/1986 Lindner ..... F04B 7/06 417/500
4,863,358 A * 9/1989 Lindner ..... F04B 7/06 417/500
5,032,067 A * 7/1991 Progl ..... F16N 13/04 184/33
5,074,767 A * 12/1991 Gerlach ..... F04B 7/06 417/500
5,158,441 A * 10/1992 Aid ..... F04B 7/06 417/500
5,209,502 A * 5/1993 Savoia ..... F16J 15/3228 277/562
5,312,233 A * 5/1994 Tanny ..... F04B 7/0038 417/316
5,403,169 A * 4/1995 Yokoi ..... F04B 53/164 277/563
5,494,420 A * 2/1996 Mawhirt ..... F04B 7/06 417/499
5,601,421 A * 2/1997 Lee ..... F04B 7/06 417/492
5,863,187 A * 1/1999 Bensley ..... F04B 1/324 417/218
6,044,821 A * 4/2000 Weng ..... F02F 1/16 123/193.2
6,113,365 A * 9/2000 Siegel ..... F04B 1/0404 417/434
6,161,466 A * 12/2000 Schuller ..... B60T 8/4031 417/470
6,913,933 B2 * 7/2005 Jacobs ..... B01L 3/0289 422/130
7,785,084 B1 * 8/2010 Rawlings ..... F04B 13/00 417/500
8,562,310 B1 * 10/2013 Rawlings ..... F04B 13/00 417/360
8,747,941 B2 * 6/2014 Kwak ..... G02F 1/1341 427/58
9,027,929 B2 * 5/2015 Picha ..... G01N 35/1097 277/314
9,250,106 B2 * 2/2016 Rosinko ..... A61M 5/16854
9,416,775 B2 * 8/2016 Focht ..... A61M 5/14216
9,726,172 B2 * 8/2017 Wattellier ..... F04C 2/00
9,964,101 B2 * 5/2018 Rawlings ..... F04B 13/00
10,514,031 B2 * 12/2019 Ballario ..... F16J 15/20
2004/0241023 A1 * 12/2004 Pinkerton, III ..... F04B 7/06 417/461
2005/0031466 A1 * 2/2005 Chenoweth ..... F04B 15/08 417/375
2007/0237658 A1 * 10/2007 Burns ..... F04B 7/06 417/417
2007/0273105 A1 * 11/2007 Stanton ..... F04B 53/164 277/500
2008/0187449 A1 * 8/2008 Breidenbach ..... F04B 7/06 417/499
2010/0326271 A1 * 12/2010 Stang ..... F04B 53/008 92/170.1
2012/0086171 A1 * 4/2012 Picha ..... G01N 35/1097 277/314
2013/0293647 A1 * 11/2013 Dannhauser ..... B41M 5/0017 347/102
2016/0131132 A1 * 5/2016 Stockner ..... F04B 53/143 277/436
2017/0218950 A1 8/2017 Mizukoshi
2018/0360572 A1 * 12/2018 Bolleter ..... A61C 8/0012

FOREIGN PATENT DOCUMENTS

JP 2001-248543 A 9/2001
JP 2008-051392 A 3/2008
JP 2017-137780 A 8/2017

* cited by examiner

PLUNGER PUMP HAVING A ROTATABLE PLUNGER WITH CUT FACE DISPOSED IN A CYLINDER WHEREIN THE CYLINDER INCLUDES A MAIN BODY AND A SPACER SECTION WITH THE SPACER SECTION HAVING A GREATER LENGTH IN AN AXIAL DIRECTION THAN THE MAXIMUM STROKE LENGTH OF THE PLUNGER

TECHNICAL FIELD

The present invention relates to a plunger pump that transfers fluid by rotating and reciprocating a plunger in a cylinder chamber to let a suction port and a discharge port alternately communicate with the cylinder chamber.

BACKGROUND TECHNOLOGY

A conventional plunger pump is a device that transfers fluid by rotating and reciprocating a plunger having a cut face on the outer periphery of its distal end in a cylinder chamber to let a suction port and a discharge port alternately communicate with the cylinder chamber (see, for example, Patent Document 1 and Patent Document 2). In such a plunger pump, if a fluid to be transferred has characteristics of precipitation or depositing, precipitation or depositing may occur and disables sliding of the plunger in the cylinder.

In order to improve this defect, depositing prevention ports for supplying a washing liquid from an outer device of the plunger pump is provided. The washing liquid washes away the fluid having characteristics of precipitation or depositing from the clearance between the inner circumferential face of the cylinder and the outer circumferential face of the plunger to prevent stopping of the pump caused by precipitation or depositing.

PRIOR ART

Patent Documents

Patent Document 1: Japanese Laid-Open Patent Application No. 2001-248543

Patent Document 2: Japanese Laid-Open Patent Application No. 2008-51392

Patent Document 3: Japanese Laid-Open Patent Application No. 2017-137780

SUMMARY OF THE INVENTION

Problems to be Solved by the Invention

However, under some operating conditions, such as the place where the pump is set and the operating environment, there are cases that the washing liquid cannot be used or an additional flow passage for the washing liquid, including the depositing prevention ports, cannot be provided. Meanwhile, there is known a plunger pump having a further improved structure that can prevent stopping of the pump caused by precipitation or depositing regardless of the operating condition of the pump (see, for example, Patent document 3).

It is an object of the present invention to provide a plunger pump that prevents liquid leakage and stopping of the pump caused by precipitation or depositing under any operating condition.

Means to Solve Problems

According to the present invention, there is provided a plunger pump including a cylinder having inside a cylinder chamber; a plunger disposed in the cylinder so as to be relatively movable forward and backward to the cylinder chamber so that an outer circumferential face of the plunger is in slide contact with an inner circumferential face of the cylinder, and having a cut face on an outer periphery of an distal end; and a suction port and a discharge port provided to the cylinder to communicate with the cylinder chamber, the plunger pump transferring fluid by reciprocating the plunger in an axial direction while rotating the plunger relative to the cylinder chamber to let the suction port and the discharge port alternately communicate with the cylinder chamber, wherein the cylinder includes a cylinder main body and a spacer section being disposed in an inner portion of a proximal end side of the cylinder main body, and sliding against a portion of the plunger closer to a proximal end side than a portion of the plunger advancing and retracting into the cylinder chamber, and the plunger pump further includes a seal section provided on the proximal end side of the cylinder for sealing the cylinder main body, the plunger and the spacer section.

In another embodiment of the present invention, the cylinder main body is made of a material having first hardness, and the spacer section is made of a resin material having second hardness lower than the first hardness.

In still another embodiment of the present invention, the spacer section is made of a material having at least one of water repellency and wear resistance.

In still another embodiment of the present invention, the first hardness is 8 to 13 in Mohs hardness and the second hardness is 130 or lower in Rockwell hardness of an R scale.

In still another embodiment of the present invention, the resin material is any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

Advantage of the Invention

According to the present invention, it is possible to prevent liquid leakage and stopping of the pump caused by precipitation or depositing under any operating condition.

DESCRIPTION OF THE PREFERRED EMBODIMENTS

There will be described a plunger pump according to embodiments of the present invention below in detail with reference to the attached drawings. All embodiments will be described not by way of limiting the scope of the claims of the present invention. Combinations of the features described in the embodiments are not always necessary to constitute the means for solving the problem according to the present invention.

First Embodiment

Figure 1:
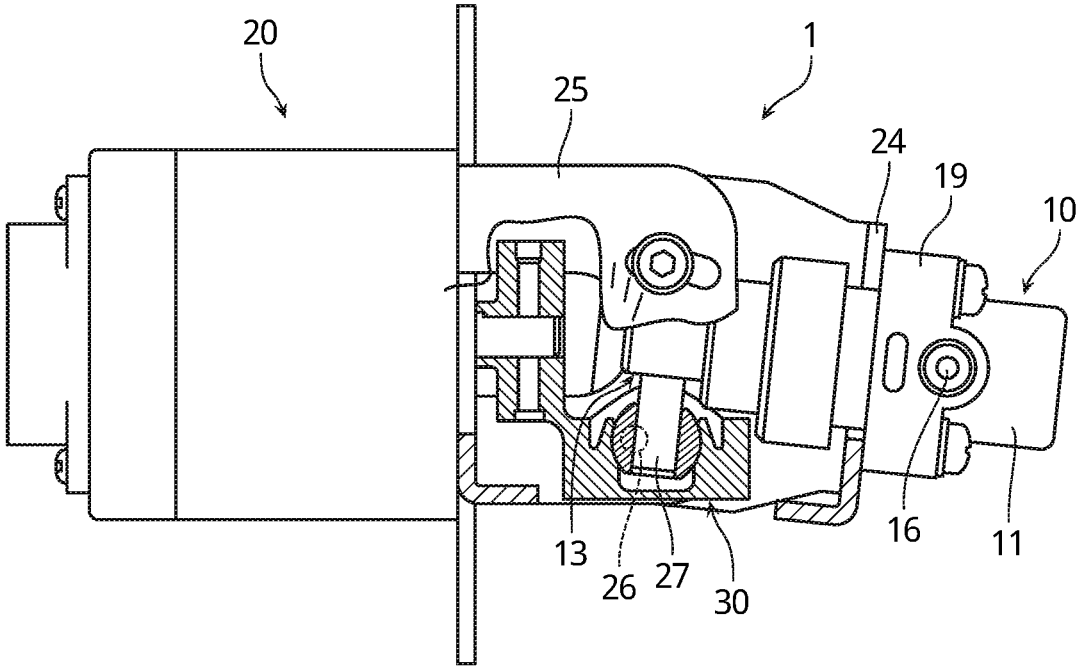
FIG. 1 is a partially cut out front view illustrating a plunger pump according to a first embodiment of the present invention.
Figure 2:
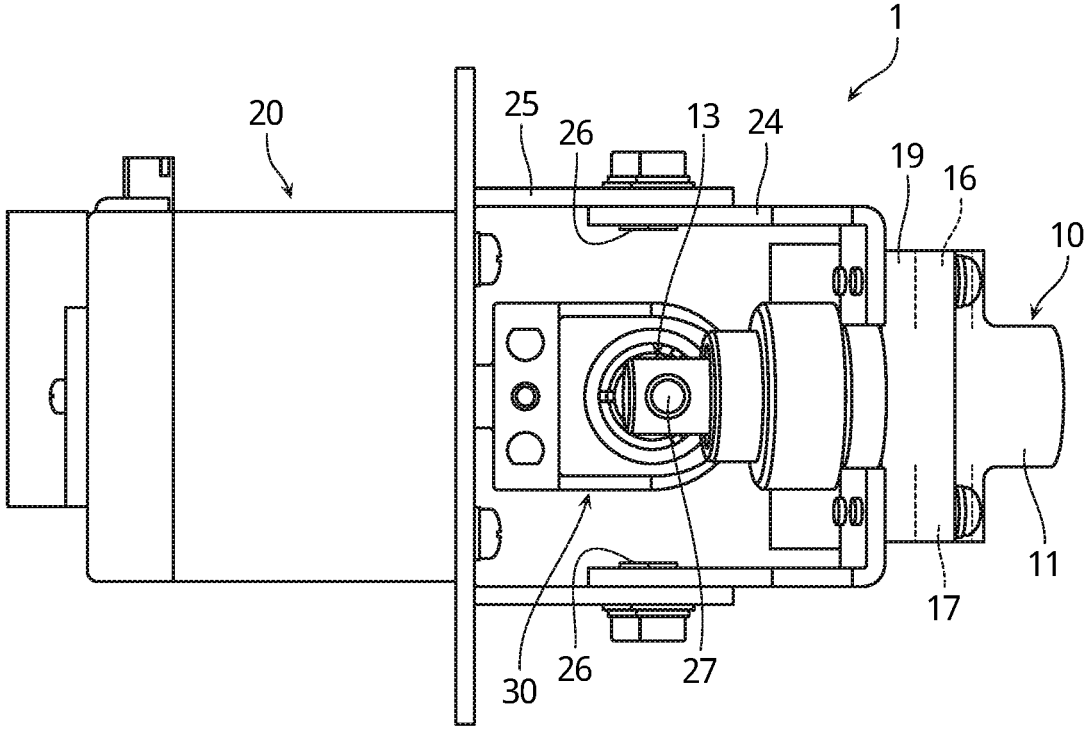
FIG. 2 is a side view illustrating the plunger pump according to the first embodiment.

As illustrated in FIGS. 1 and 2, the plunger pump 1 according to the first embodiment is usable mainly for transferring fluid that has characteristics of precipitation, depositing or very high permeability. The fluid to be transferred may be a fluid that easily causes precipitation or depositing, or fluid having high permeability, such as buffer liquid (buffer solution) similar to normal saline solution and various reagents used in, for example, a medical analysis device, and dialysis solution used in a dialysis device.

Figure 3:
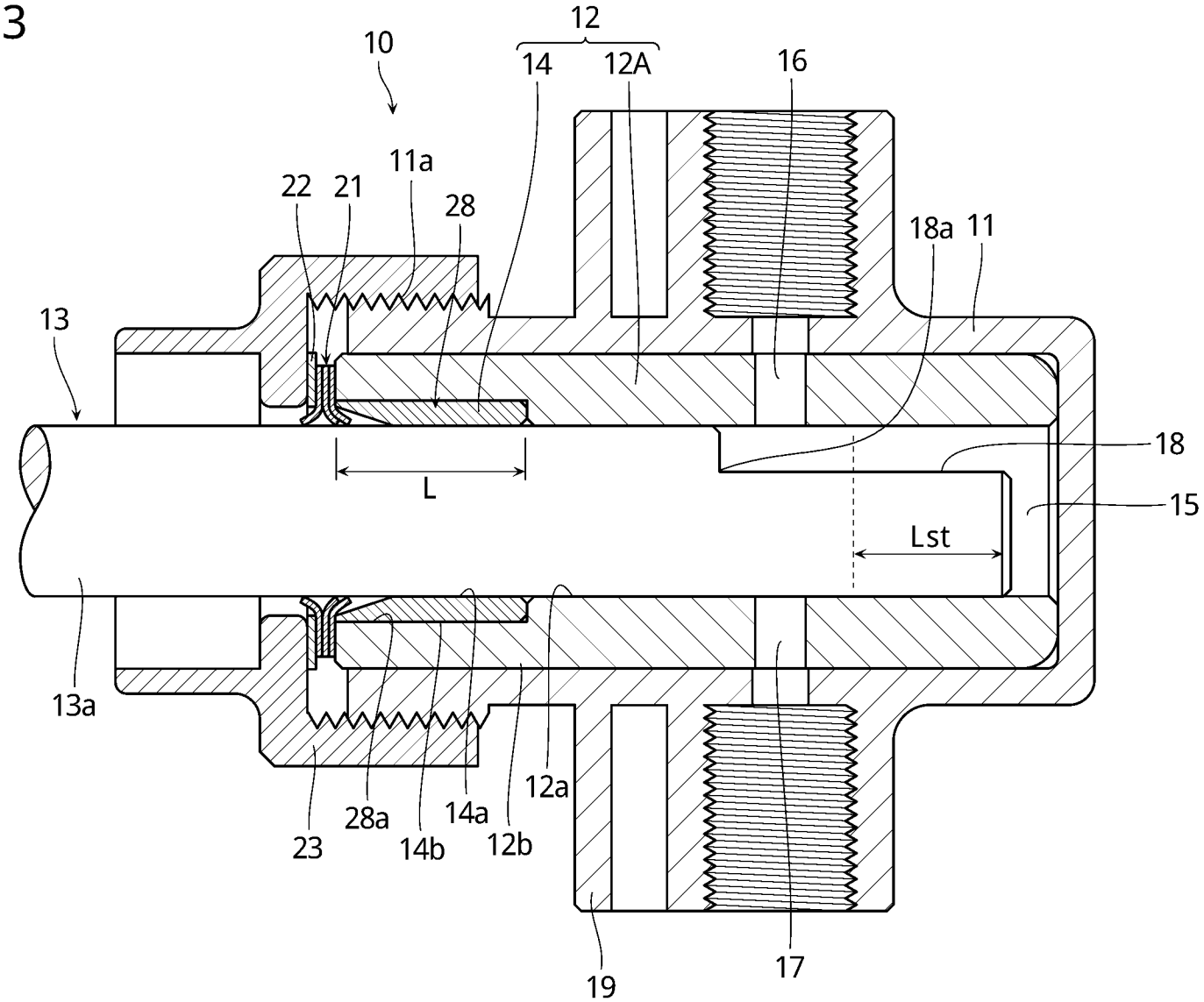
FIG. 3 is a sectional view illustrating a pump head of the plunger pump according to the first embodiment.

The plunger pump 1 includes a pump head 10 as a main part of the pump, a motor 20 that drives a plunger 13 of the pump head 10, and a drive joint unit 30 that joins the plunger 13 and the motor 20. As illustrated in FIG. 3, the pump head 10 includes a cylinder 12 housed in a pump bracket 11 made of, for example, polyvinylidene fluoride (PVDF) resin or chlorotrifluoroethylene-ethylene copolymer (ECTFE), and the plunger 13 inserted in the cylinder 12.

The cylinder 12 of the plunger pump 1 according to the first embodiment includes a cylinder main body 12A and a spacer section 14, in which a cylinder chamber 15 plugged by a pump bracket 11 is formed at the distal end of the cylinder 12. Specifically, the cylinder 12 includes the cylinder main body 12A, for example, of cylindrical shape, and the spacer section 14 disposed in the inner portion of a proximal end side of the cylinder main body 12A and being slide contact with the plunger 13. The spacer section 14 is, for example, pushed in a housing hole 28 formed so as to open to the proximal end side of the cylinder main body 12A. An inner circumferential face 12*a* of the cylinder main body 12A and an inner circumferential face 14*a* of the spacer section 14 are substantially concentric with each other and form the cylindrical surfaces at the substantially same level.

On the other hand, since the spacer section 14 is disposed in the housing hole 28 in the inner portion of the cylinder main body 12A, an outer circumferential face 12*b* of the cylinder main body 12A and an outer circumferential face 14*b* of the spacer section 14 form the cylindrical surfaces at different level such that the diameter of the outer circumferential face 12*b* is larger than that of the outer circumferential face 14*b*, though they are concentric with each other.

The inner circumferential face 12*a* of the cylinder and the inner circumferential face 14*a* of the spacer are in slide contact with the outer circumferential face 13*a* of the plunger 13. The cylinder main body 12A and the plunger 13 are made of, for example, ceramic material, more specifically, alumina ($Al_2O_3$) ceramic material having the Mohs hardness of 8 to 13.

The cylinder main body 12A has a valve-less suction port 16 and a valve-less discharge port 17 in a position communicating with the cylinder chamber 15 such that they oppose each other in a direction perpendicular to the axial direction of the cylinder main body 12A. The plunger 13 has a cut face 18 formed on the outer periphery of the distal end. A pin 27 is attached to the proximal end of the plunger 13 perpendicularly to the shaft of the plunger 13 (see FIG.1). The pin 27 is coupled via the drive joint unit 30 to the rotating shaft of the motor 20.

The rotating shaft of the plunger 13 and the rotating shaft of the motor 20 are not in line but are adjusted to intersect at a predetermined angle. Accordingly, the plunger 13 is driven by the motor 20 to rotate and reciprocate in the axial direction relative to the cylinder chamber 15. This motion causes the suction port 16 and the discharge port 17 to alternately communicate with the cylinder chamber 15 via the cut face 18, and thereby the transferred fluid is suctioned through the suction port 16 and discharged through the discharge port 17. The fluid is thereby transferred.

A flange 19 for mounting the pump head 10 to the distal face of a front frame 24 is provided in the vicinity of the proximal end section of the pump bracket 11. An insert flange (not shown) made of, for example, aluminum may be inserted into the flange 19 for reinforcing it. A screw section 11*a* is formed in the proximal end section of the pump bracket 11. A screw nut 23 made of, for example, polypropylene (PP) resin or polyvinylidene fluoride (PVDF) resin is mounted on the screw section 11*a*.

Lip seals (axial seals) 21 as a seal section are fitted between the proximal end section side of the cylinder main body 12A and the proximal end side of the spacer section 14, and the nut 23 through a back sheet 22 arranged on the side of the nut 23. The lip seals 21 are fitted in a state in which it is in close contact with the proximal end face of the cylinder main body 12A, the circumferential face 13*a* of the plunger and the proximal end face of the spacer section 14 to seal the cylinder main body 12A, the plunger 13 and the spacer section 14. In the first embodiment, the lip seals 21 are made of a polytetrafluoroethylene (PTFE) resin. The lip seals 21 are formed of a laminate of a plurality of (for example, three) sheet members. Aback sheet 22 functions as a buffer material for preventing the breakage of the lip seals 21 caused by the nut 23.

The motor 20 is, for example a stepping motor. The drive joint unit 30 is housed in the front frame 24 and the rear frame 25 which are made of, for example, stainless steel (SUS 304). A pivot shaft 26 allows the pump head 10 to be adjusted to any angle to the rear frame 25 or the like.

Thus configured plunger pump 1 according to the first embodiment is in a start state when the suction port 16 is in communication with the cylinder chamber 15 as the leading side edge of the cut face 18 on the distal end of the plunger 13 is brought into contact with the suction port 16 along with the rotation of the plunger 13. From this state, when the plunger 13 rotates in a predetermined direction and retracts out of the cylinder chamber 15 of the cylinder main body 12A, the suction state starts in which the fluid is sucked through the suction port 16 into the cylinder chamber 15.

Subsequently, when the trailing side edge of the cut face 18 on the distal end of the plunger 13 moves away from the suction port 16, the suction port 16 is plugged by the plunger 13 and the suction stroke ends. Then, when the leading side edge of the cut face 18 on the distal end of the plunger 13 is brought to be in contact with the discharge port 17, the discharge port 17 is in communication with the cylinder chamber 15.

Simultaneously, the plunger 13 is rotated and pushed into the cylinder chamber 15 of the cylinder main body 12A and the phase switches to the discharge stroke in which the fluid is discharged from the cylinder chamber 15 through the discharge port 17. Then, the trailing side edge of the cut face 18 on the distal end of the plunger 13 moves away from the discharge port 17 to plug the discharge port 17 with the plunger 13, thereby ending the discharge stroke. The plunger 13 is further rotated to return to the start state described above. The similar motion is repeated to transfer the fluid from the suction port 16 to the discharge port 17.

The plunger pump 1 may stop during an operation by such a cause that will be described below. The seal section including the above-described lip seals 21 is secured to the proximal end section of the pump bracket 11 through the back sheet 22 by means of the nut 23 to prevent the fluid that has flowed in the axial direction of the plunger 13 through a slight clearance between the plunger 13 and the cylinder main body 12A from leaking outside the pump bracket 11.

Furthermore, the seal section (the lip seals 21) also prevent intrusion of the ambient air into the inside of the spacer section 14 which may cause precipitation or depositing. The seal section is disposed on the proximal end section side of the cylinder main body 12A such that the effects described above are best achieved together with the spacer section 14 as illustrated in Figure.

Since, however, the plunger pump 1 is configured such that the plunger 13 reciprocates relative to the cylinder main body 12A, a slight amount of fluid leaks out on the surface of the plunger 13 (outer circumferential face 13*a* of the plunger). The fluid might leak outside if the lip seals 21 as the seal section wear or deteriorate.

If a precipitate forms in the fluid or a depositing occurs in the fluid, the precipitate or the deposit intrudes into the clearance between the plunger 13 and the cylinder main body 12A by reciprocation of the plunger 13. The plunger 13 and the cylinder main body 12A made of a very hard alumina ceramic material that hardly deforms as described above will not deform against a foreign object intruded in a slight gap and bites the foreign object. This causes locking and stops the pump.

In the first embodiment, the sliding portion between the plunger 13 and the cylinder main body 12A where such a foreign object easily intrudes, that is, the spacer section 14, is made of a softer material than those of the plunger 13 and the cylinder main body 12A and is housed in the housing hole 28 of the cylinder main body 12A.

With this configuration, when a foreign object is intruded into the clearance between the plunger 13 and the cylinder main body 12A, the spacer section 14 in the housing hole 28 of the cylinder main body 12A moderately deforms or wears in relation to hardness and wearability regarding the foreign object. This avoids the foreign object being bitten between the plunger 13 and the cylinder main body 12A, and thus prevents the pump from stopping. Furthermore, the proximal end section side of the spacer section 14 is tapered so that the inner circumferential face 14*a* of the spacer gradually expands toward the outer circumferential face 14*b* of the spacer. Accordingly, it is possible to prevent interference between the portion, which is warped in the axial direction of the inner circumferential section of the lip seals 21, and the spacer section 14 when actually assembling the pump head 10.

As described above, the cylinder main body 12A and the plunger 13 are made of a very hard alumina ceramic material. On the other hand, the hardness of sodium chloride (NaCl), which precipitates and deposits in the buffer liquid as a fluid, is about 2 to 2.5 in Mohs hardness (about 60 to 100 in Vickers hardness), for example. The hardness of calcium carbonate ($CaCO_3$), which precipitates and deposits in a dialysis solution is, for example, about 3 in Mohs hardness.

Meanwhile, the spacer section 14 is made of, for example, a material having the Rockwell hardness of about 130 or lower in R scale. The resin material is preferably any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

In this case, PTFE resin has the Rockwell hardness of about 20 in R scale. PP resin has the Rockwell hardness of about 65 to 96 in R scale. PE resin has the Rockwell hardness of about 40 in R scale. Furthermore, PVDF resin has the Rockwell hardness of about 93 to 116 in R scale. UHMWPE resin has the Rockwell hardness of about 50 to 56 in R scale. Still furthermore, PPS resin has the Rockwell hardness of about 123 in R scale. Furthermore, PEEK resin, PSU resin and POM resin each has the Rockwell hardness of about 120 in R scale. Still furthermore, PA6 resin has the Rockwell hardness of about 119 in R scale.

Thus, the material for the spacer section 14 is required to be softer than the precipitate and deposit made of sodium chloride or calcium carbonate or to have such a strength that allows deformation caused by the moving actions of the plunger 13 and precipitate or deposit.

A typical resin material such as plastics, most of which are usually too soft to be evaluated by the Mohs hardness, has a strength that allows deformation and wear by a precipitate or a deposit and thus can be used for the spacer section 14 without any problems.

Preferable resin materials satisfying these requirements are the PTFE resin, the PP resin, the PE resin, the PVDF resin, UHMWPE resin, the PPS resin, the PEEK resin, the PSU resin, the POM resin and the PA6 resin as described above. Consequently, any resin material satisfying the Rockwell hardness of about 130 or lower in R scale can be used to form the spacer section 14 that is able to prevent stopping of the pump caused by precipitation or depositing under any operating condition.

Besides, the spacer section 14 may be made of a water-repellant material. In order to improve water-repellency, for example, an additive may be mixed in the resin material described above, a surface property may be modified, or the surface of the inner circumferential face 14*a* of the spacer section 14 may be treated (coated) with a fluorine resin material. In such a manner, the amount of the fluid flowing toward the proximal end side of the spacer section 14 can be reduced furthermore, and the influence caused by precipitation and depositing is further minimized. Moreover, the spacer section 14 maybe made of a wear resistant material, more preferably a high wear resistant material. Where a high wear resistant material such as a UHMWPE resin is used, occurrence of wear in the spacer section 14 due to precipitation or depositing can be delayed to keep the initial shape of the spacer section 14 for a long time. In such a manner, the clearance between the spacer section 14 and the plunger 13 can be maintained within a narrow range to reduce the flow amount of fluid flowing toward the proximal end side of the spacer section 14, thus reducing an influence due to precipitation or depositing. In addition, since the generation of the abrasion powder of the spacer section 14 itself and the deposition amount of the abrasion powder can be suppressed to reduce factors for inhibiting sliding motion of the plunger 13 in the plunger pump 1.

As illustrated in FIG. 3, in the first embodiment, for example, the plunger pump 1 has length L larger than length Lst, where L is the length in the axial direction from the proximal end of the sliding portion of the spacer section 14 that slides against the plunger 13 to the distal end of the spacer section 14 and Lst is the maximum stroke length of the reciprocation of the plunger 13. Configured as described above, the precipitate or deposit formed in the proximal end side of the plunger 13 at a place exposed to the atmospheric gas (air) can hardly be conveyed to the distal end side of the cylinder main body 12A through the spacer section 14 by stroking of the plunger 13, thereby to more suitably prevent stopping of the pump caused by precipitation or depositing.

The maximum length L of the spacer section 14 in the axial direction may be set, for example, smaller than length which is the length from the proximal end of the sliding portion of the spacer section 14 to the boundary step 18*a* of the cut face 18 on the outer circumferential face 13*a* of the plunger 13 in a fully retracted position. This way, the plunger can operate so that the cut face 18 is always faced to the inner circumferential face 12*a* of the cylinder and thus the leakage of the fluid toward the proximal end portion side of the plunger 13 can be prevented. Moreover, the discharge amount is less affected in a case under a high secondary pressure.

Moreover, as described above, since the fluid to be transferred flows between the inner circumferential face 12*a* of the cylinder main body 12A and the outer circumferential face 13*a* of the plunger 13, it flows as it is through leakage paths which are a clearance between the inner circumferential face 14*a* of the spacer section 14 and the outer circumferential face 13*a* of the plunger, and a clearance between the outer circumferential face 14*b* of the spacer section 14 and the inner circumferential face 28*a* of the housing hole 28 through the step portion of the housing hole 28 in the cylinder main body 12A.

Since the first embodiment, however, employs a configuration in which the lip seals 21 as a seal section seals the cylinder main body 12A, the plunger 13 and the spacer section 14, the liquid leakage on the base side of the pump head 10 can be effectively prevented even if the fluid has a high permeability. According to the plunger pump of the first embodiment, therefore, it is possible to prevent liquid leakage and stopping of the pump caused by precipitation or depositing under any operating condition.

Second Embodiment

There will be described a plunger pump 1 according to the second embodiment.

Hereinafter in the description including FIG. 4, the same component as the first embodiment is appended with the same reference numeral and repeated description thereof is omitted.

Figure 4:
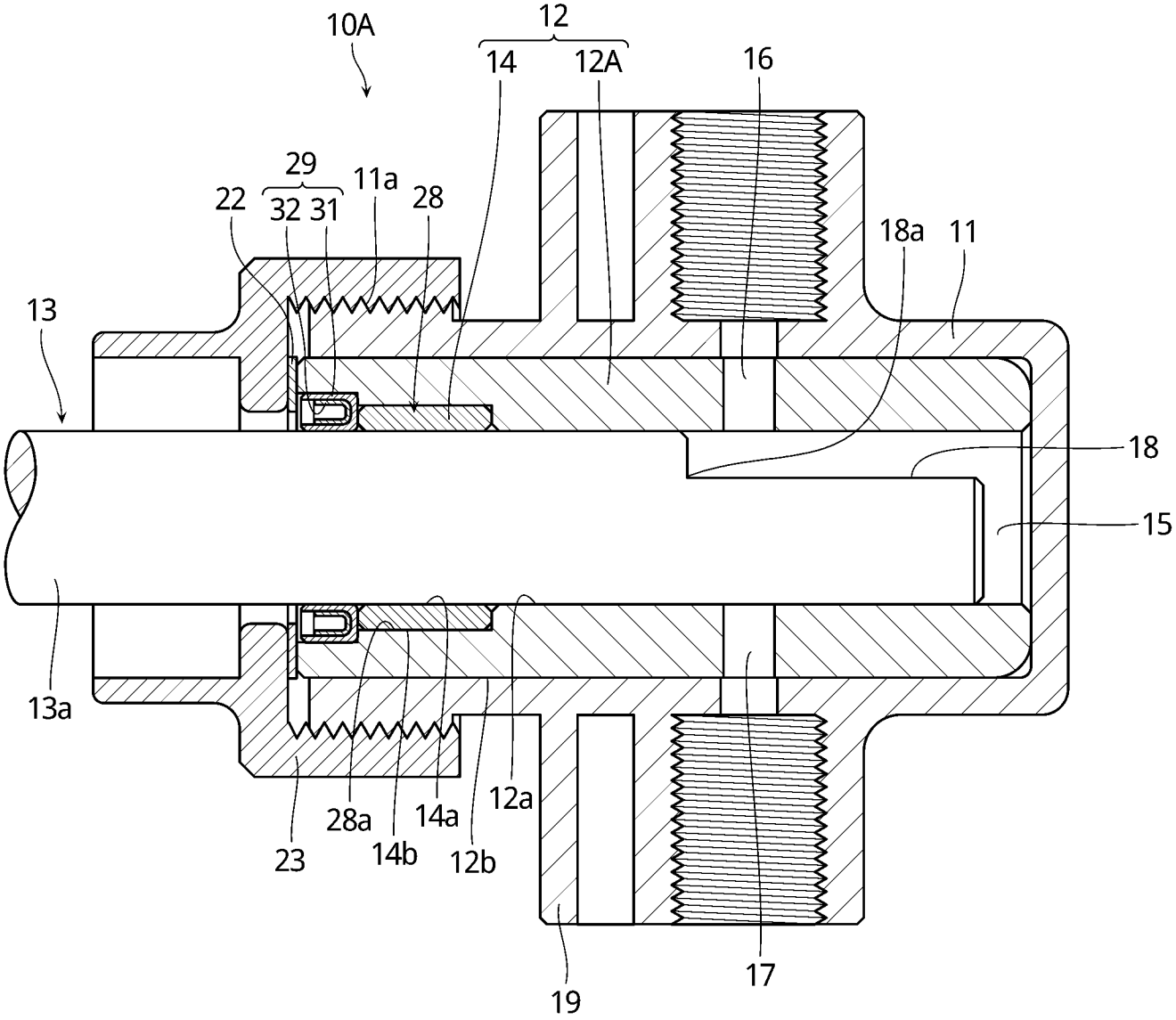
FIG. 4 is a sectional view illustrating the pump head of a plunger pump according to a second embodiment of the present invention.

As illustrated in FIG. 4, the pump head 10A of the plunger pump 1 according to the second embodiment includes the spacer section 14 and a Variseal 29 as a seal portion arranged on the proximal end side of the spacer section 14 in the housing hole 28 of the cylinder main body 12A. In this point, the pump head 10A of the second embodiment is different from the the pump head 10 of the plunger pump 1 according to the first embodiment in which the spacer section 14 is housed in the housing hole 28 and the lip seals 21 as a seal section is disposed on the proximal end side of the cylinder main body 12A and the proximal end side of the spacer section 14.

The Variseal 29 is made of, for example, an ultra high molecular weight polyethylene seal 31 and a metal spring 32, and constitute the seal section. Since the seal section containing the Variseal 29 seals the cylinder main body 12A, the plunger 13 and the spacer section 14 in the same manner as with the seal section formed of the lip seals 21, it plays a role in blocking the leakage path described above. Namely, since the fluid flowing the clearance between the inner circumferential face 14*a* of the spacer section 14 and the outer circumferential face 13*a* of the plunger, and the clearance between the outer circumferential face 14*b* of the spacer section 14 and the inner circumferential face 28*a* of the housing hole 28 through the step portion of the housing hole 28, is blocked also by the Variseal 29 employed instead of the lip seals 21, it is possible to prevent effectively liquid leakage also in the second embodiment even if the fluid has a high permeability, and thereby to achieve the same effect as that of the first embodiment.

The Other Embodiments

The plunge pump may be provided with the following configuration and illustration thereof is omitted. For example, a liquid reservoir formed of a space of concave shape or groove shape may be provided in at least one of the inner circumferential face 14*a* of the spacer section 14, inner circumferential face 12*a* of the cylinder main body 12A and outer circumferential face 13*a* of the plunger 13. The liquid reservoir can keep each of sliding portions with the outer circumferential face 13*a* of the plunger 13 in a wet condition, thereby reducing occurrence of precipitation and depositing.

Furthermore, a washing liquid tube maybe formed in the pump bracket 11 and a depositing prevention port communicating with the washing liquid tube and a wash chamber may be provided in the cylinder main body 12A. The washing liquid is supplied from the external to the wash chamber through the washing liquid tube and the depositing prevention ports. The washing liquid can wash off the fluid, which has characteristics of precipitation and depositing, intruded from the cylinder chamber 15 into the clearance between the inner circumferential face 12*a* of the cylinder and the outer circumferential face 13*a* of the plunger. Even if the fluid cannot be washed off completely in the wash chamber, the spacer section 14 disposed in the cylinder main body 12A and the lip seals 21 or Variseal 29 as a seal section can effectively prevent liquid leakage and stopping of the pump caused by precipitation or depositing.

Moreover, a seal member corresponding to the Variseal 29 may be employed instead of the Variseal 29 in the other embodiment. For example, the Variseal 29 promotes a sealing property between the ultra high molecular weight polyethylene seal 31 and the plunger 13 by fastening action of the metal spring 32. Even if an O ring made of rubber material is employed as an elastic member instead of the metal spring 32, the same seal property can be obtained. Furthermore, in the still other embodiment, the Variseal 29 may be inserted into the housing hole 28 in the opposite direction to that described above. When the Variseal 29 is disposed in the opposite direction, sealing at a higher pressure can be performed since the pressure of the fluid is applied from the opening side. In this case, where it is undesirable that the metal spring is in contact with the fluid, the opening side of the Variseal 29 may be clogged with still another seal member.

Furthermore, in the other embodiment, where small amount of the liquid leakage occurs near the proximal end side of the plunger 13 in the plunger pump 1 or the liquid leakage is a level causing no problem when using the pump, only the spacer section 14 can be disposed in the housing hole 28 without employing the lip seals 21 or Variseal 29 (and the back sheet 22 together therewith).

The several embodiments are described above by way of illustration, not by way of limiting the scope of the present invention. These novel embodiments can be set forth in other various forms. Omission, substitution, and alteration can be made in various ways without departing from the spirit and the scope of the present invention. The embodiments and modifications thereof are included in the spirit and the scope of the present invention and within the scope of the invention recited in the claims and within the scope according to the doctrine of equivalence.

In the embodiments described above, for example, the cylinder main body 12A and the plunger 13 each is made of an alumina ceramic material having the Mohs hardness of 8 to 13. The materials of the cylinder main body 12A and the plunger 13 maybe a combination of materials as will be described below. Namely, if the cylinder main body 12A is made of silicon carbide (SiC) having the Mohs hardness of 13, the plunger 13 is also made of silicon carbide.

If the cylinder main body 12A is made of an alumina ceramic material, the plunger 13 is made of zirconia ceramic material having the Mohs hardness of 8 to 8.5. In the other case, the plunger 13 maybe made of a stainless steel material (SUS 316). In this case, since resin, stainless steel (SUS316), zirconia ceramic material, alumina ceramic material, and silicon carbide become harder in this order, these materials do not contradict the description of the present invention. The material of the spacer section 14 may be one of various materials softer than the crystal of the foreign object. A high torque is required of the motor 20 to cause deformation of the spacer section 14, so that the matching between the motor torque and the material of the spacer section 14 is essential.

What is claimed is:

1. A plunger pump comprising:

a cylinder having inside a cylinder chamber;

a plunger disposed in the cylinder so as to be relatively movable forward and backward to the cylinder chamber along an axial direction of the plunger so that an outer circumferential face of the plunger is in slide contact with an inner circumferential face of the cylinder, and having a cut face on an outer periphery of an distal end; and a suction port and a discharge port provided to the cylinder to communicate with the cylinder chamber, the plunger pump transferring fluid by reciprocating the plunger in an axial direction while rotating the plunger relative to the cylinder chamber to let the suction port and the discharge port alternately communicate with the cylinder chamber, wherein the cylinder includes a cylinder main body and a spacer section being disposed in an inner portion of a proximal end side of the cylinder main body, and sliding against a portion of the plunger closer to the proximal end side than a portion of the plunger advancing and retracting into the cylinder chamber, the plunger pump further comprises a seal section provided on the proximal end side of the cylinder for sealing the cylinder main body, the plunger and the spacer section, a length of the spacer section in the axial direction of the plunger is smaller than a length from a proximal end of the spacer section to a boundary step of the cut face on the outer circumferential face of the plunger in a fully retracted position, and the length of the spacer section in the axial direction of the plunger is larger than a maximum stroke length of reciprocation of the plunger.

2. The plunger pump according to claim 1, wherein the cylinder main body is made of a material having first hardness, and the spacer section is made of a resin material having second hardness lower than the first hardness.

3. The plunger pump according to claim 2, wherein the spacer section is made of the resin material, the resin material having at least one of water repellency and wear resistance.

4. The plunger pump according to claim 2, wherein the first hardness is 8 to 13 in Mohs hardness and the second hardness is 20 to 130 in Rockwell hardness of an R scale.

5. The plunger pump according to claim 4, wherein the first hardness is 8 to 13 in Mohs hardness and the second hardness is 20 to 130 in Rockwell hardness of an R scale.

6. The plunger pump according to claim 2, wherein the resin material is any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

7. The plunger pump according to claim 3, wherein the resin material is any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

8. The plunger pump according to claim 4, wherein the resin material is any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

9. The plunger pump according to claim 5, wherein the resin material is any one of PTFE (polytetrafluoroethylene) resin, PP (polypropylene) resin, PE (polyethylene) resin, PVDF (polyvinylidene fluoride) resin, UHMWPE (ultra high molecular weight polyethylene) resin, PPS (polyphenylene sulfide) resin, PEEK (polyether ether ketone) resin, PSU (polysulfone) resin, POM (polyacetal) resin, and PA6 (polyamide 6, 6-nylon) resin.

* * * * *